US010237647B1

(12) United States Patent
Chhetri

(10) Patent No.: US 10,237,647 B1
(45) Date of Patent: Mar. 19, 2019

(54) ADAPTIVE STEP-SIZE CONTROL FOR BEAMFORMER

(71) Applicant: Amazon Technologies, Inc., Seattle, WA (US)

(72) Inventor: Amit Singh Chhetri, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 5 days.

(21) Appl. No.: 15/446,557

(22) Filed: Mar. 1, 2017

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2410/01* (2013.01); *H04R 2430/21* (2013.01)

(58) Field of Classification Search
CPC .... H04R 3/005; H04R 1/406; H04R 2410/01; H04R 2430/21; H04R 2430/23; H04R 2203/12
USPC ..... 381/92, 71.1, 94.1
See application file for complete search history.

(56) References Cited

U.S. PATENT DOCUMENTS

| | | | | |
|---|---|---|---|---|
| 8,954,324 | B2 * | 2/2015 | Wang | G10L 25/78 704/215 |
| 9,456,276 | B1 | 9/2016 | Chhetri | |
| 2006/0153360 | A1 * | 7/2006 | Kellermann | H04M 9/082 379/406.08 |
| 2010/0246851 | A1 * | 9/2010 | Buck | G10L 21/0208 381/94.1 |
| 2012/0327115 | A1 | 12/2012 | Chhetri et al. | |
| 2013/0301846 | A1 * | 11/2013 | Alderson | H04R 3/002 381/71.7 |

* cited by examiner

*Primary Examiner* — Ahmad F. Matar
*Assistant Examiner* — Sabrina Diaz
(74) *Attorney, Agent, or Firm* — Pierce Atwood LLP

(57) ABSTRACT

A beamformer system that can isolate a desired portion of an audio signal resulting from a microphone array. A combination of beamformers is used to dampen undesired noise, whether diffuse or coherent. A fixed beamformer is used to dampen diffuse noise while an adaptive beamformer is used to cancel directional coherent noise. The adaptive beamformer isolates and weights audio from various directions. The weights may vary depending on the isolated desired audio signal, dynamically adjusting the step-size adjustments to the weights.

16 Claims, 10 Drawing Sheets

ADAPTIVE STEP-SIZE CONTROL FOR BEAMFORMER

BACKGROUND

In audio systems, beamforming refers to techniques that are used to isolate audio from a particular direction. Beamforming may be particularly useful when filtering out noise from non-desired directions. Beamforming may be used for various tasks, including isolating voice commands to be executed by a speech-processing system.

BRIEF DESCRIPTION OF DRAWINGS

For a more complete understanding of the present disclosure, reference is now made to the following description taken in conjunction with the accompanying drawings.

DETAILED DESCRIPTION

Beamforming systems isolate audio from a particular direction in a multi-directional audio capture system. One technique for beamforming involves boosting audio received from a desired direction while dampening audio received from a non-desired direction.

In one example of a beamformer system, a fixed beamformer employs a filter-and-sum structure, as explained below, to boost an audio signal that originates from the desired direction (sometimes referred to as the look-direction) while largely attenuating audio signals that original from other directions. A fixed beamformer may effectively eliminate certain diffuse noise (e.g., undesirable audio), which is detectable in similar energies from various directions, but may be less effective in eliminating noise emanating from a single source in a particular non-desired direction.

To improve the isolation of desired audio while also removing coherent, directional-specific noise, offered is a beamforming component that incorporates not only a fixed beamformer to cancel diffuse noise, but also an adaptive beamformer/noise canceller that can adaptively cancel noise from different directions depending on audio conditions. The adaptive beamformer may incorporate an adaptive step-size controller that, depending on noise conditions, adjust how quickly the adaptive beamformer weights audio from particular directions from which noise may be canceled. For example, if speech from a user is detected (and desired), the system may reduce the adaptive step size to continue processing audio (and cancelling noise) without drastically adjusting the noise cancelling operations. In other conditions the adaptive step size may change more frequently to adapt to the changing audio environment detected by the system.

The step-size value may be controlled for each channel (e.g., audio input direction) and may be individually controlled for each frequency subband (e.g., range of frequencies) and/or on a frame-by-frame basis (e.g., dynamically changing over time) where a frame refers to a particular window of an audio signal/audio data (e.g., 25 ms).

Figure 1A:
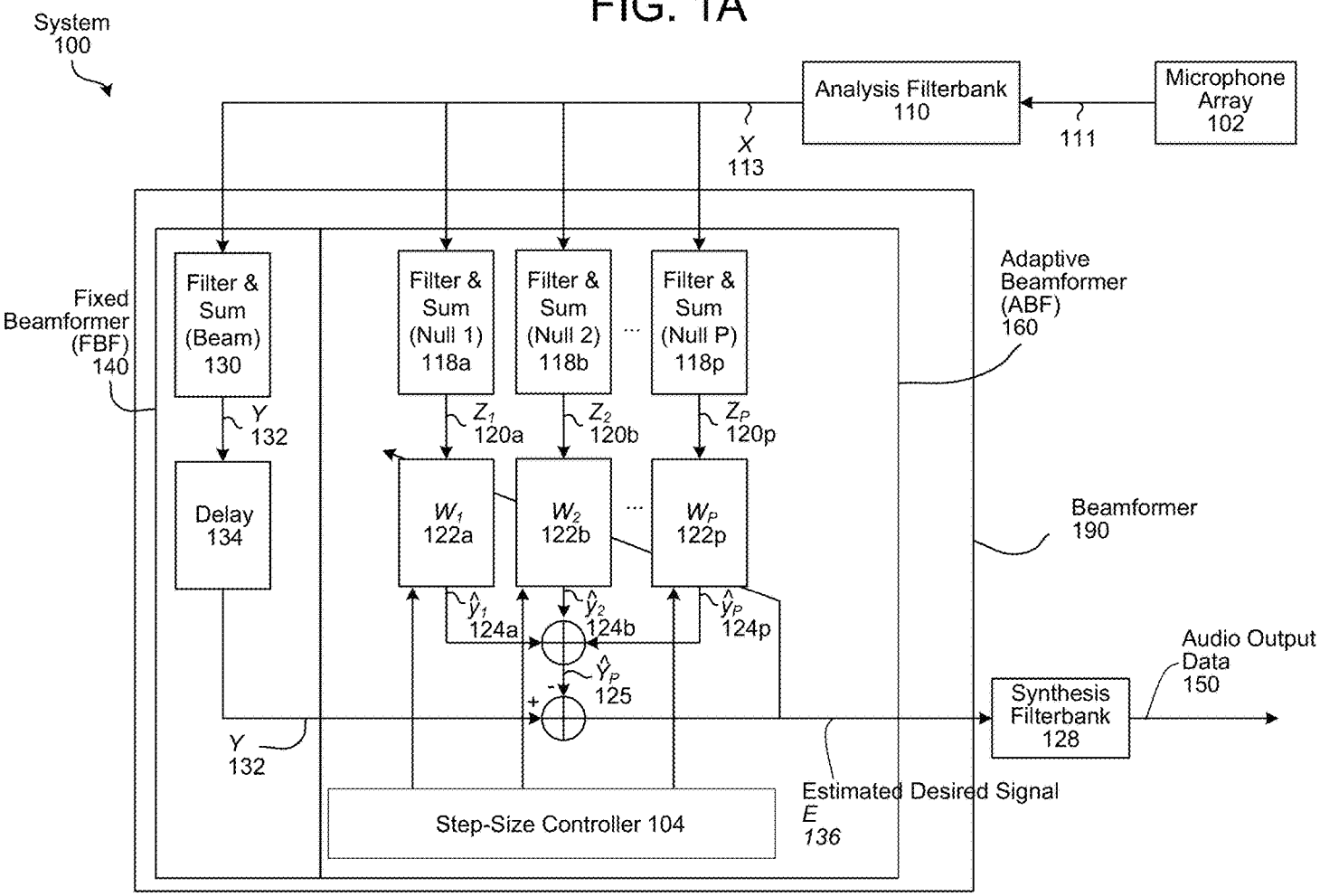
FIG. 1A illustrates a beamforming system that combines a fixed beamformer and an adaptive beamformer according to embodiments of the present disclosure.
Figure 1B:
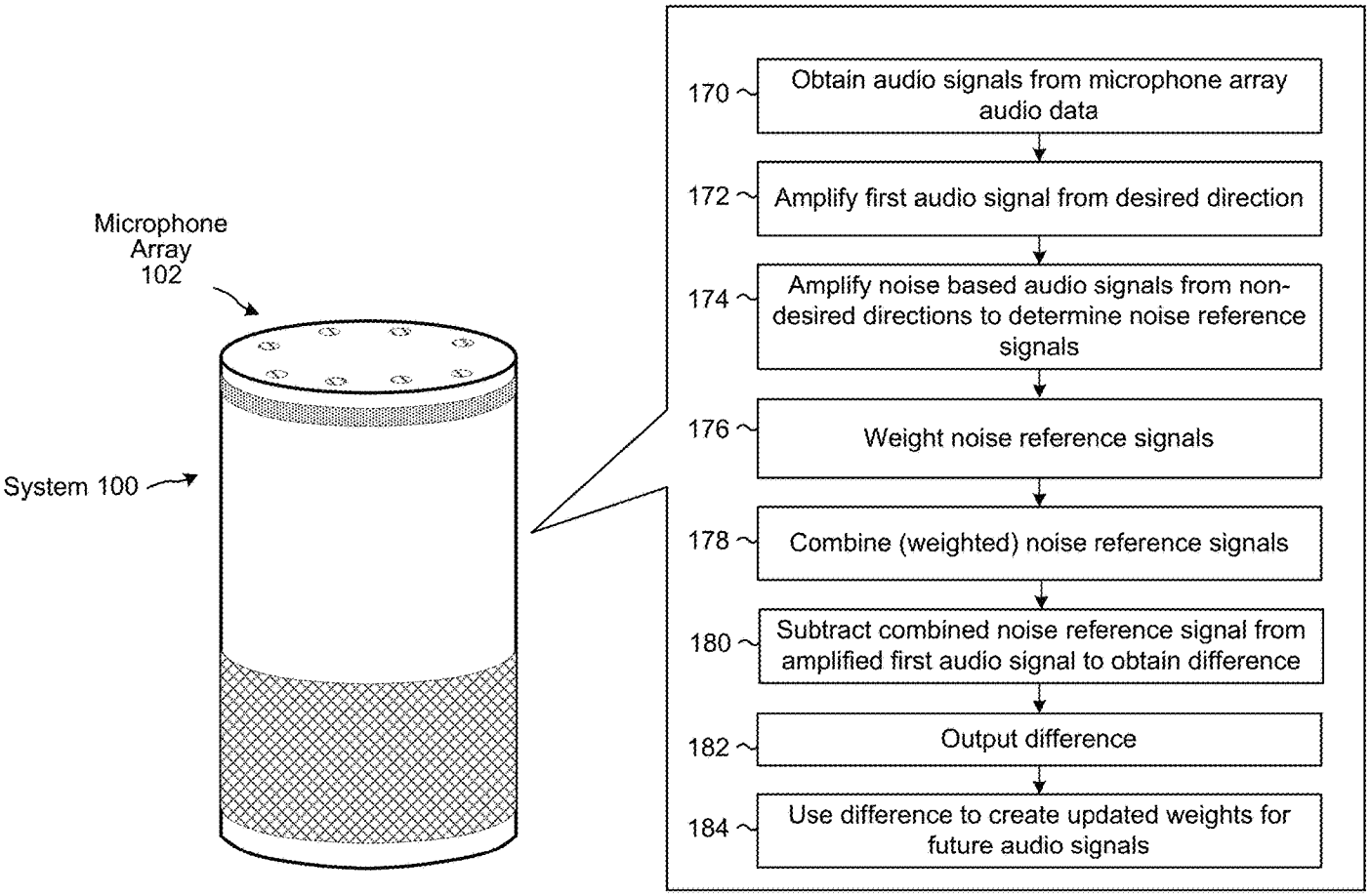
FIG. 1B illustrates a method for isolating desired audio using the beamforming system according to embodiments of the present disclosure.

FIG. 1A illustrates a high-level conceptual block diagram of a system 100 configured to performing beamforming using a fixed beamformer and an adaptive noise canceller that can remove noise from particular directions using adaptively controlled coefficients which can adjust how much noise is cancelled from particular directions. As shown in FIG. 1B, the system 100 obtains (170) audio signals (113) from audio data 111 from a microphone array 102. For example, the audio data 111 is received form the microphone array 102 and processed by an analysis filterbank 110, which converts the audio data 111 from the time domain into the frequency/sub-band domain, where $x_m$ denotes the time-domain microphone data for the mth microphone, m=1, . . . , M. The filterbank 110 divides the resulting audio signals into multiple adjacent frequency bands, resulting in audio signal X 113. The system 100 then operates a fixed beamformer (FBF) to amplify (172) a first audio signal from a desired direction to obtain an amplified first audio signal 132. For example, the audio signal 113 may be fed into a fixed beamformer (FBF) component 140, which may include a filter and sum component 130. The FBF 140 may be a separate component or may be included in another component such as a general beamformer 190. As explained below, the FBF may operate a filter and sum component 130 to isolate the first audio signal from the direction of an audio source.

The system 100 may also operate an adaptive beamformer component (ABF) 160 to amplify (174) audio signals from directions other than the direction of an audio source. Those audio signals represent noise signals so the resulting amplified audio signals from the ABF may be referred to as noise reference signals 120, discussed further below. The system 100 may then weight (176) the noise reference signals, for example using filters 122 discussed below. The system may combine (178) the weighted noise reference signals 124 into a combined (weighted) noise reference signal 125. Alternatively the system may not weight the noise reference signals and may simply combine them into the combined noise b reference signal 125 without weighting. The system may then subtract (180) the combined noise reference signal 125 from the amplified first audio signal 132 to obtain a difference 136. The system may then output (182) that difference, which represents the desired output audio signal with the noise removed. The diffuse noise is removed by the FBF when determining the signal 132 and the directional noise is removed when the combined noise reference signal 125 is subtracted. The system may also use (184) the difference to create updated weights (for example for filters 122) to create updated weights that may be used to weight future audio signals. The step-size controller 104 may be used modulate the rate of adaptation from one weight to an updated weight.

In this manner noise reference signals are used to adaptively estimate the noise contained in the output of the FBF signal using the noise-estimation filters 122. This noise estimate is then subtracted from the FBF output signal to obtain the final ABF output signal. The ABF output signal is also used to adaptively update the coefficients of the noise-estimation filters. Lastly, we make use of a robust step-size controller to control the rate of adaptation of the noise estimation filters.

Further details of the system operation are described below following a discussion of directionality in reference to FIGS. 2-4B.

Figure 2:
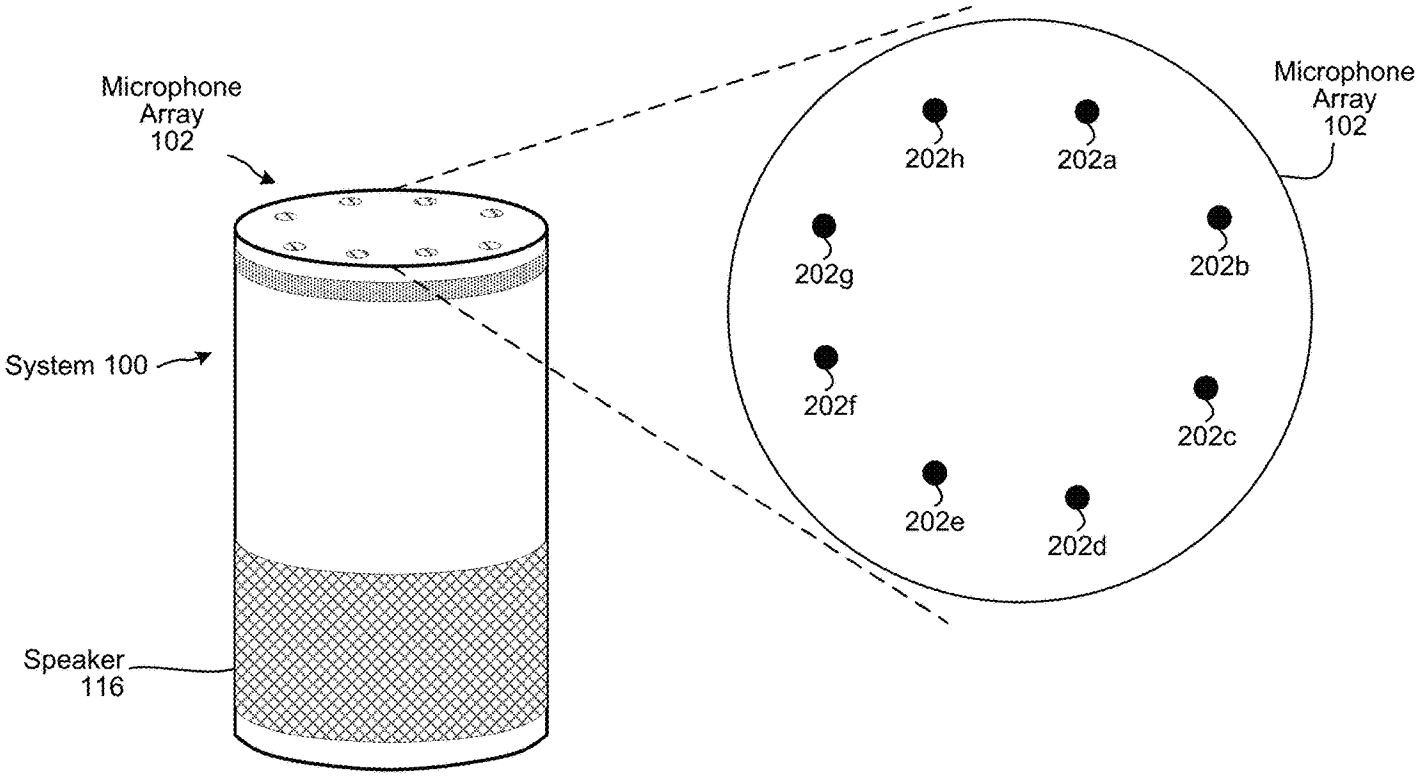
FIG. 2 illustrates a microphone array according to embodiments of the present disclosure.

As illustrated in FIG. 2, a system 100 may include, among other components, a microphone array 102, a speaker 116, a beamformer 190 (as illustrated in FIG. 1A), or other components. The microphone array may include a number of different individual microphones. As illustrated in FIG. 2, the array 102 includes eight (8) microphones, 202*a*-202*h*. The individual microphones may capture sound and pass the resulting audio signal created by the sound to a downstream component, such as analysis filterbank 110. Each individual piece of audio data captured by a microphone may be in a time domain. To isolate audio from a particular direction, the system may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the system may determine that the source of the audio that resulted in the segment of audio data may be located closer to the first microphone than to the second microphone (which resulted in the audio being detected by the first microphone before being detected by the second microphone).

Figure 3:
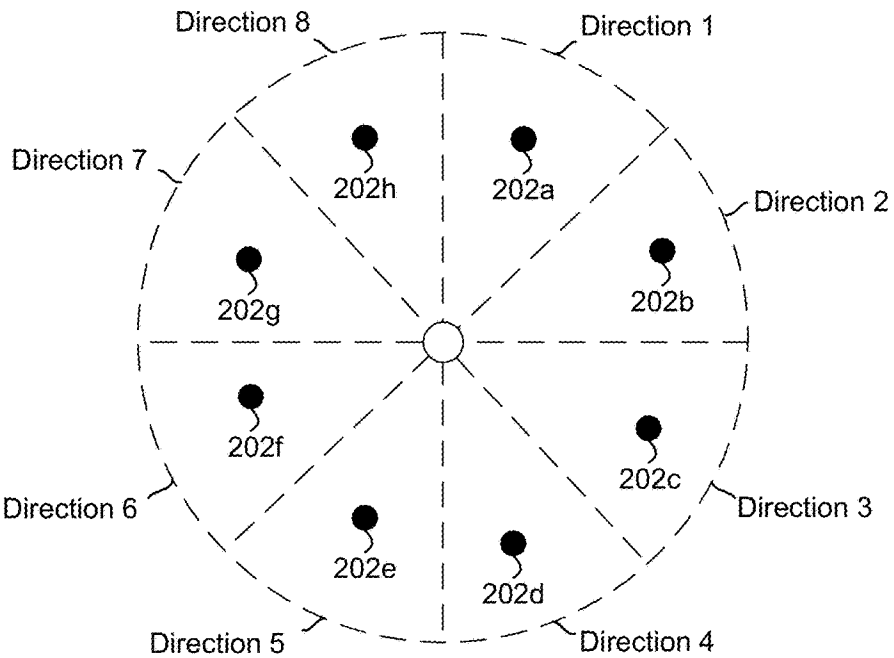
FIG. 3 illustrates associating directions with microphones of a microphone array according to embodiments of the present disclosure.

Using such direction isolation techniques, a system 100 may isolate directionality of audio sources. As shown in FIG. 3, a particular direction may be associated with a particular microphone of a microphone array, where the azimuth angles for the plane of the microphone array may be divided into bins (e.g., 0-45 degrees, 46-90 degrees, and so forth) where each bin direction is associated with a microphone in the microphone array. For example, direction 1 is associated with microphone 202*a*, direction 2 is associated with microphone 202*b*, and so on.

To isolate audio from a particular direction the system may apply a variety of audio filters to the output of the microphones where certain audio is boosted while other audio is dampened, to create isolated audio corresponding to a particular direction, which may be referred to as a beam. While the number of beams may correspond to the number of microphones, this need not be the case. For example, a two-microphone array may be processed to obtain more than two beams, thus using filters and beamforming techniques to isolate audio from more than two directions. Thus, the number of microphones may be more than, less than, or the same as the number of beams. The beamformer of the system may have an ABF/FBF processing pipeline for each beam.

The system may use various techniques to determine the beam corresponding to the look-direction. If audio is detected first by a particular microphone the system 100 may determine that the source of the audio is associated with the direction of the microphone in the array. Other techniques may include determining what microphone detected the audio with a largest amplitude (which in turn may result in a highest strength of the audio signal portion corresponding to the audio). Other techniques (either in the time domain or in the sub-band domain) may also be used such as calculating a signal-to-noise ratio (SNR) for each beam, performing voice activity detection (VAD) on each beam, or the like.

Figure 4A:
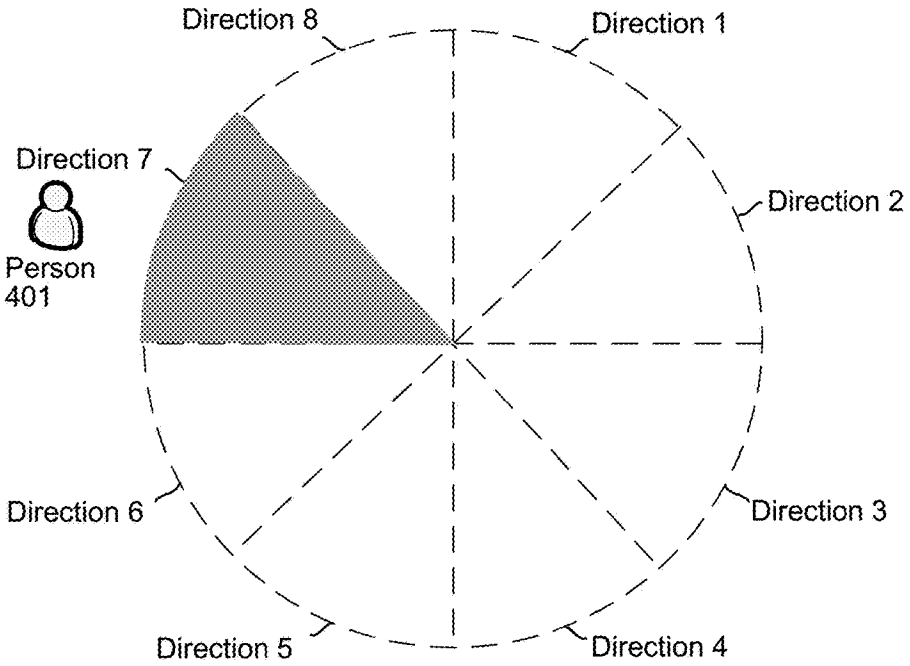
FIGS. 4A and 4B illustrate isolating audio from a direction to focus on a desired audio source according to embodiments of the present disclosure.

For example, if audio data corresponding to a user's speech is first detected and/or is most strongly detected by microphone 202*g*, the system may determine that the user is located in a location in direction 7. Using a FBF 140 or other such component, the system may isolate audio coming from direction 7 using techniques known to the art and/or explained herein. Thus, as shown in FIG. 4A, the system 100 may boost audio coming from direction 7, thus increasing the amplitude of audio data corresponding to speech from user 401 relative to other audio captured from other directions. In this manner, noise from diffuse sources that is coming from all the other directions will be dampened relative to the desired audio (e.g., speech from user 401) coming from direction 7.

Figure 4B:
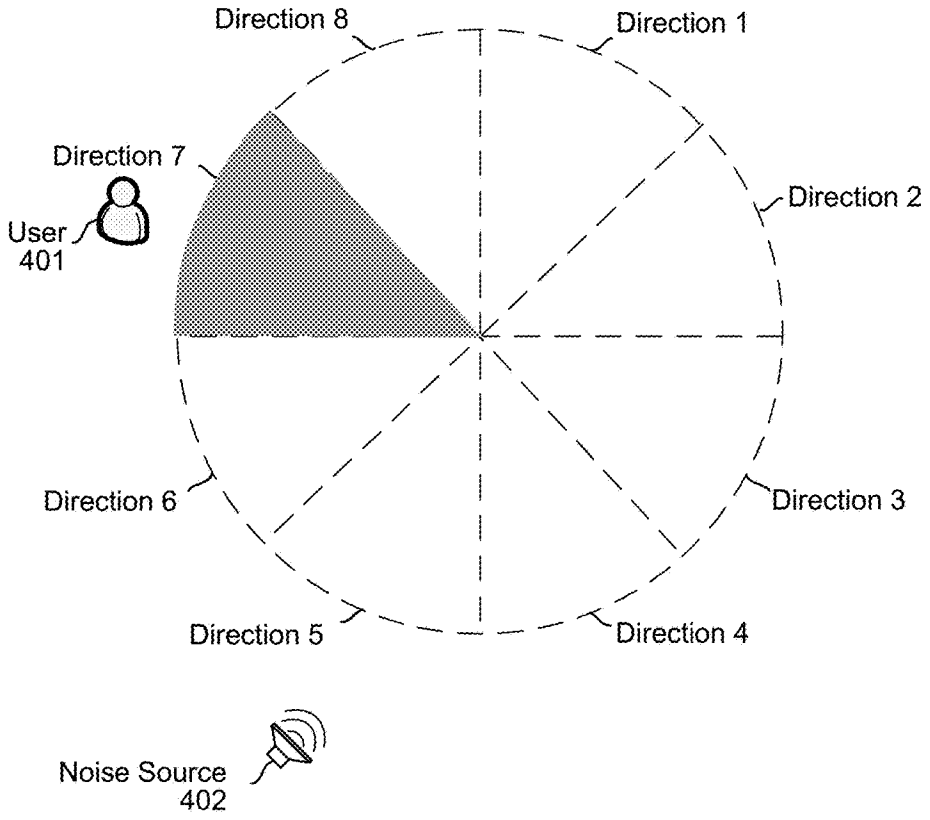

One drawback to the FBF approach is that it may not function as well in dampening/cancelling noise from a noise source that is not diffuse, but rather coherent and focused from a particular direction. For example, as shown in FIG. 4B, a noise source 402 may be coming from direction 5 but may be sufficiently loud that noise cancelling/beamforming techniques using an FBF alone may not be sufficient to remove all the undesired audio coming from the noise source 402, thus resulting in an ultimate output audio signal determined by the system 100 that includes some representation of the desired audio resulting from user 401 but also some representation of the undesired audio resulting from noise source 402.

To remove the undesired directional noise from noise source 402, the adaptive noise cancelling system of FIG. 1A may be used.

As shown in FIG. 1A, audio data 111 captured by a microphone array may be input into an analysis filterbank 110. The filterbank 110 may include a uniform discrete Fourier transform (DFT) filterbank which converts audio data 111 in the time domain into an audio signal X 113 in the sub-band domain. The audio signal X may incorporate audio signals corresponding to multiple different microphones as well as different sub-bands (i.e., frequency ranges) as well as different frame indices (i.e., time ranges). Thus the audio signal from the mth microphone may be represented as $X_m(k,n)$, where k denotes the sub-band index and n denotes the frame index. The combination of all audio signals for all microphones for a particular sub-band index frame index may be represented as X(k,n).

Figure 5:
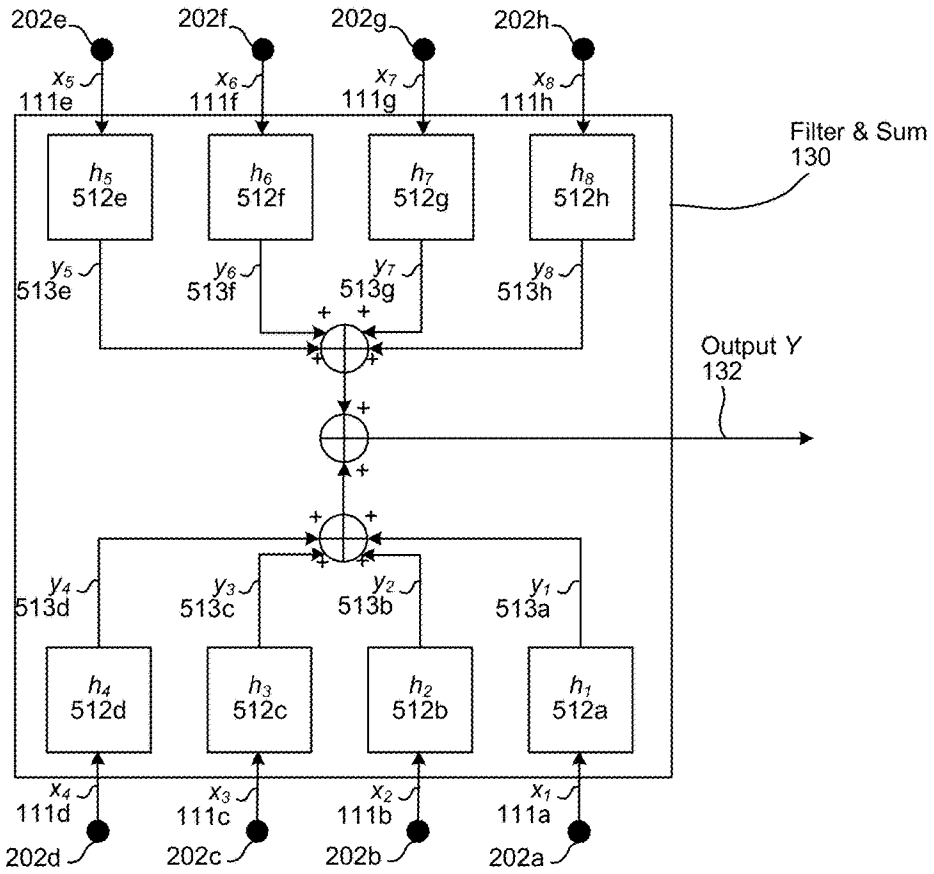
FIG. 5 illustrates a filter and sum component according to embodiments of the present disclosure.

The audio signal X 113 may be passed to the FBF 140 including the filter and sum unit 130. The FBF 140 may be implemented as a robust super-directive beamformer, delayed sum beamformer, or the like. The FBF 140 is presently illustrated as a super-directive beamformer (SDBF) due to its improved directivity properties. The filter and sum unit 130 takes the audio signals from each of the microphones and boosts the audio signal from the microphone associated with the desired look direction and attenuates signals arriving from other microphones/directions. The filter and sum unit 130 may operate as illustrated in FIG. 5. As shown in FIG. 5, the filter and sum unit 130 may be configured to match the number of microphones of the microphone array. For example, for a microphone array with eight microphones, the filter and sum unit may have eight filter blocks 512. The audio signals $x_1$ 111*a* through $x_8$ 111*h* for each microphone are received by the filter and sum unit 130. The audio signals $x_1$ 111*a* through $x_8$ 111*h* correspond to individual microphones 202*a* through 202*h*, for example audio signal $x_1$ 111*a* corresponds to microphone 202*a*, audio signal $x_2$ 111*b* corresponds to microphone 202*b* and so forth. Although shown as originating at the microphones, the audio signals $x_1$ 111*a* through $x_8$ 111*h* may be in the sub-band domain and thus may actually be output by the analysis filterbank before arriving at the filter and sum component 130. Each filter block 512 is also associated with a particular microphone. Each filter block is configured to either boost (e.g., increase) or dampen (e.g., decrease) its respective incoming audio signal by the respective beamformer filter coefficient h depending on the configuration of the FBF. Each resulting filtered audio signal y 513 will be the audio signal x 111 weighted by the beamformer filter coefficient h of the filter block 512. For example, $y_1=x_1*h_1$, $y_2=x_2*h_2$, and so forth. The filter coefficients are configured for a particular FBF associated with a particular beam.

Figure 6:
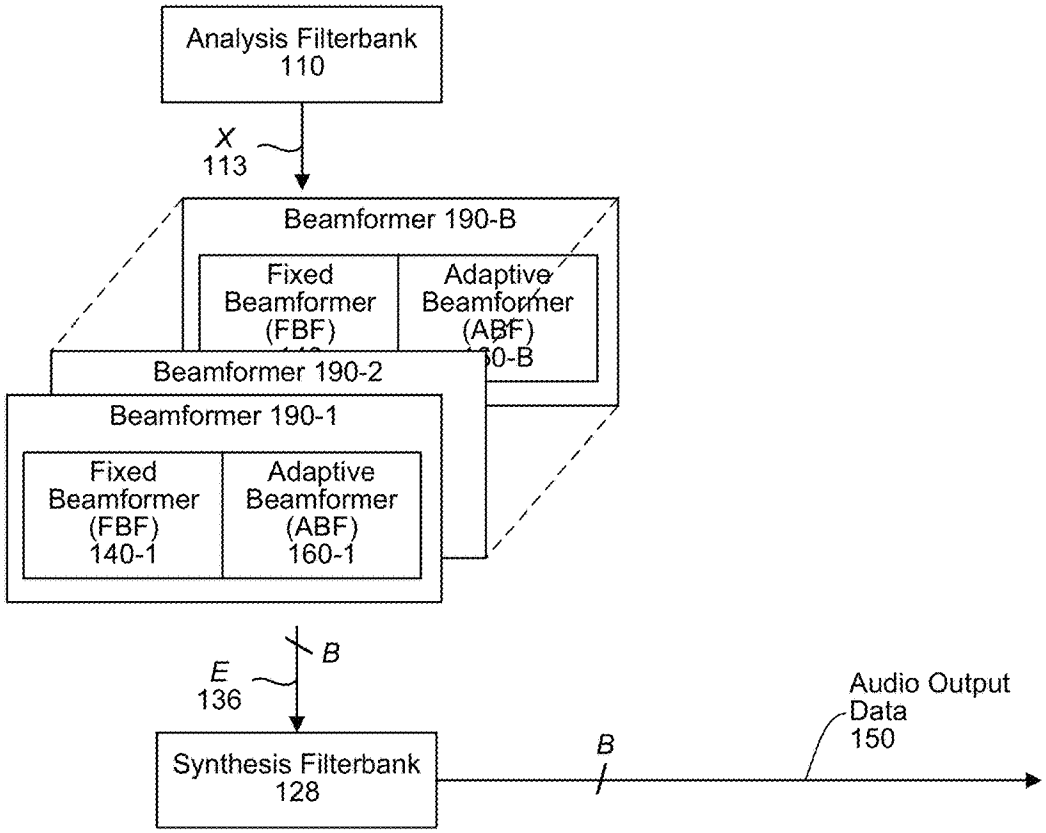
FIG. 6 illustrates a multiple FBF/ABF beamformer configuration for each beam according to embodiments of the present disclosure.

As illustrated in FIG. 6, the beamformer 190 configuration (including the FBF 140 and the ABF 160) illustrated in FIG. 1A, may be implemented multiple times in a single system 100. The number of beamformer 190 blocks may correspond to the number of beams B. For example, if there are eight beams, there may be eight FBF components 140 and eight ABF components 160. Each beamformer 190 may operate as described in reference to FIG. 1A, with an individual output E 136 for each beam created by the respective beamformer 190. Thus, B different outputs 136 may result. For system configuration purposes, there may also be B different other components, such as the synthesis filterbank 128, but that may depend on system configuration. Each individual beam pipeline may result in its own audio output data 150, such that there may be B different audio output data portions 150. A downstream component, for example a speech recognition component, may receive all the different audio output data 150 and may use some processing to determine which beam (or beams) correspond to the most desirable output audio data (for example a beam with a highest SNR output audio data or the like).

Each particular FBF may be tuned with filter coefficients to boost audio from one of the particular beams. For example, FBF 140-1 may be tuned to boost audio from beam 1, FBF 140-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF 140-7 direction 7, the beamformer filter coefficient $h_7$ for filter 512*g* may be high while beamformer filter coefficients $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the output audio signal The filtered audio signals will then be summed together to create the output audio signal Y 132. Thus, the FBF 140 may phase align microphone data toward a give n direction and add it up. So signals that are arriving from a particular direction are reinforced, but signals that are not arriving from the look direction are suppressed. The robust FBF coefficients are designed by solving a constrained convex optimization problem and by specifically taking into account the gain and phase mismatch on the microphones.

The individual beamformer filter coefficients may be represented as $H_{BF,m}(r)$, where r=0, . . . R, where R denotes the number of beamformer filter coefficients in the subband domain. Thus, the output Y 132 of the filter and sum unit 130 may be represented as the summation of each microphone signal filtered by its beamformer coefficient and summed up across the M microphones:

$$Y(k, n) = \sum_{m=1}^{M} \sum_{r=0}^{R} H_{BF,m}(r) X_m(k, n-r) \quad \text{(Equation 1)}$$

Turning once again to FIG. 1A, the output Y 132, expressed in Equation 1, may be fed into a delay component 134, which delays the forwarding of the output Y until further adaptive noise cancelling functions as described below may be performed. One drawback to output Y 132, however, is that it may include residual directional noise that was not canceled by the FBF 140. To remove that directional noise, the system 100 may operate an adaptive beamformer 160 which includes components to obtain the remaining noise reference signal which may be used to remove the remaining noise from output Y.

As shown in FIG. 1A, the adaptive noise canceller may include a number of nullformer blocks 118*a* through 118*p*. The system 100 may include P number of nullformer blocks 118 where P corresponds to the number of channels, where each channel corresponds to a direction in which the system may focus the nullfomers 118 to isolate detected noise. The number of channels P is configurable and may be predetermined for a particular system 100. Each nullformer block is configured to operate similarly to the filter and sum block 130, only instead of the filter coefficients for the nullformer blocks being selected to boost the look ahead direction, they are selected to boost one of the other, non-look ahead directions. Thus, for example, nullformer 118*a* is configured to boost audio from direction 1, nullformer 118*b* is configured to boost audio from direction 2, and so forth. Thus, the nullformer may actually dampen the desired audio (e.g., speech) while boosting and isolating undesired audio (e.g., noise). For example, nullformer 118*a* may be configured (e.g., using a high filter coefficient $h_1$ 512*a*) to boost the signal from microphone 202*a*/direction 1, regardless of the look ahead direction. Nullformers 118*b* through 118*p* may operate in similar fashion relative to their respective microphones/directions, though the individual coefficients for a particular channel's nullformer in one beam pipeline may differ from the individual coefficients from a nullformer for the same channel in a different beam's pipeline. The output Z 120 of each nullformer 118 will be a boosted signal corresponding to a non-desired direction. As audio from non-desired direction may include noise, each signal Z 120 may be referred to as a noise reference signal. Thus, for each channel 1 through P the adaptive beamformer 160 calculates a noise reference signal Z 120, namely $Z_1$ 120*a* through $Z_P$ 120*p*. Thus, the noise reference signals that are acquired by spatially focusing towards the various noise sources in the environment and away from the desired look-direction. The noise reference signal for channel p may thus be represented as $Z_p(k,n)$ where $Z_P$ is calculated as follows:

$$Z_p(k, n) = \sum_{m=1}^{M} \sum_{r=0}^{R} H_{NF,m}(p, r) X_m(k, n-r) \quad \text{(Equation 2)}$$

where $H_{NF,m}(p,r)$ represents the nullformer coefficients for reference channel p.

As described above, the coefficients for the nullformer filters 512 are designed to form a spatial null toward the look ahead direction while focusing on other directions, such as directions of dominant noise sources (e.g., noise source 402). The output from the individual nullformers $Z_1$ 120*a* through $Z_P$ 120*p* thus represent the noise from channels 1 through P.

The individual noise reference signals may then be filtered by noise estimation filter blocks 122 configured with weights W to adjust how much each individual channel's noise reference signal should be weighted in the eventual combined noise reference signal $\hat{Y}$ 125. The noise estimation filters (further discussed below) are selected to isolate the noise to be removed from output Y 132. The individual channel's weighted noise reference signal $\hat{y}$ 124 is thus the channel's noise reference signal Z multiplied by the channel's weight W. For example, $\hat{y}_1=Z_1*W_1$, $\hat{y}_2=Z_2*W_2$, and so forth. Thus, the combined weighted noise estimate $\hat{Y}$ 125 may be represented as:

$$W_p(k,n) = W_p(k,n-1) + \frac{\mu_p(k,n)}{\|Z_p(k,n)\|^2 + \varepsilon} + Z_p(k,n)E(k,n) \quad \text{(Equation 5)}$$

where $W_p(k,n,l)$ is the l th element of $W_p(k,n)$ and l denotes the index for the filter coefficient in subband domain. The noise estimates of the P reference channels are then added to obtain the overall noise estimate:

$$\hat{Y}(k,n) = \sum_{p=1}^{P} \hat{Y}_p(k,n)$$

The combined weighted noise reference signal $\hat{Y}$ 125, which represents the estimated noise in the audio signal, may then be subtracted from the FBF output Y 132 to obtain a signal E 136, which represents the error between the combined weighted noise reference signal $\hat{Y}$ 125 and the FBF output Y 132. That error, E 136, is thus the estimated desired non-noise portion (e.g., target signal portion) of the audio signal and may be the output of the adaptive beamformer 160. That error, E 136, may be represented as:

$$E(k,n)=Y(k,n)-\hat{Y}(k,n) \quad \text{(Equation 4)}$$

As shown in FIG. 1A, the ABF output signal 136 may also be used to update the weights W of the noise estimation filter blocks 122 using sub-band adaptive filters, such as with a normalized least mean square (NLMS) approach:

$$\hat{Y}_P(k,n) = \sum_{l=0}^{L} W_P(k,n,l)Z_P(k,n-l) \quad \text{(Equation 3)}$$

where $Z_p(k,n)=[Z_p(k,n)\ Z_p(k,n-1)\ \ldots\ Z_p(k,n-L)]^T$ is the noise estimation vector for the pth channel, $\mu_p(k,n)$ is the adaptation step-size for the pth channel, and ε is a regularization factor to avoid indeterministic division. The weights may correspond to how much noise is coming from a particular direction.

As can be seen in Equation 5, the updating of the weights W involves feedback. The weights W are recursively updated by the weight correction term (the second half of the right hand side of Equation 5) which depends on the adaptation step size, $\mu_p(k,n)$, which is a weighting factor adjustment to be added to the previous weighting factor for the filter to obtain the next weighting factor for the filter (to be applied to the next incoming signal). To ensure that the weights are updated robustly (to avoid, for example, target signal cancellation) the step size $\mu_p(k,n)$ may be modulated according to signal conditions. For example, when the desired signal arrives from the look-direction, the step-size is significantly reduced, thereby slowing down the adaptation process and avoiding unnecessary changes of the weights W. Likewise, when there is no signal activity in the look-direction, the step-size may be increased to achieve a larger value so that weight adaptation continues normally. The step-size may be greater than 0, and may be limited to a maximum value. Thus, the system may be configured to determine when there is an active source (e.g., a speaking user) in the look-direction. The system may perform this determination with a frequency that depends on the adaptation step size.

The step-size controller 104 will modulate the rate of adaptation. Although not shown in FIG. 1A, the step-size controller 104 may receive various inputs to control the step size and rate of adaptation including the noise reference signals 120, the FBF output Y 132, the previous step size, the nominal step size (described below) and other data. The step-size controller may calculate Equations 6-12 below. In particular, the step-size controller 104 may compute the adaptation step-size for each channel p, sub-band k, and frame n. To make the measurement of whether there is an active source in the look-direction, the system may measure a ratio of the energy content of the beam in the look direction (e.g., the look direction signal in output Y 132) to the ratio of the energy content of the beams in the non-look directions (e.g., the non-look direction signals of noise reference signals $Z_1$ 120*a* through $Z_P$ 120*p*). This may be referred to as a beam-to-null ratio (BNR). For each subband, the system may measure the BNR. If the BNR is large, then an active source may be found in the look direction, if not, an active source may not be in the look direction.

The BNR may be computed as:

$$BNR_p(k,n) = \frac{B_{YY}(k,n)}{N_{ZZ,p}(k,n)+\delta},\ k \in [k_{LB}, k_{UB}] \quad \text{(Equation 6)}$$

where, $k_{LB}$ denotes the lower bound for the subband range bin and $k_{UB}$ denotes the upper bound for the subband range bin under consideration, and δ is a regularization factor. Further, $B_{YY}(k,n)$ denotes the powers of the beamformer output signal (e.g., output Y 132) and $N_{ZZ,p}(k,n)$ denotes the powers of the pth nullformer output signals (e.g., the noise reference signals $Z_1$ 120*a* through $Z_P$ 120*p*). The powers may be calculated using first order recursive averaging as shown below:

$$B_{YY}(k,n)=\alpha B_{YY}(k,n-1)+(1-\alpha)|Y(k,n)|^2$$

$$N_{ZZ,p}(k,n)=\alpha N_{ZZ,p}(k,n-1)+(1-\alpha)|Z_p(k,n)|^2 \quad \text{(Equation 7)}$$

where, $\propto\epsilon[0,1]$ is a smoothing parameter.

The BNR values may be limited to a minimum and maximum value as follows:

$$BNR_p(k,n)\epsilon[BNR_{min}, BNR_{max}]$$

the BNR may be averaged across the subband bins:

$$BNR_p(n) = \frac{1}{(k_{UB} - k_{LB} + 1)} \sum_{k_{LB}}^{k_{UB}} BNR_p(k, n) \quad \text{(Equation 8)}$$

the above value may be smoothed recursively to arrive at the mean BNR value:

$$\overline{BNR}_p(n) = \beta \overline{BNR}_p(n-1) + (1-\beta) BNR_p(n) \quad \text{(Equation 9)}$$

where β is a smoothing factor.

The mean BNR value may then be transformed into a scaling factor in the interval of [0,1] using a sigmoid transformation:

$$\xi(n) = 1 - 0.5\left(1 + \frac{\upsilon(n)}{1 + |\upsilon(n)|}\right) \quad \text{(Equation 10)}$$

$$\text{where } \upsilon(n) = \gamma(\overline{BNR}_p(n) - \sigma) \quad \text{(Equation 11)}$$

and γ and σ are tunable parameters that denote the slope (γ) and point of inflection (σ), for the sigmoid function.

Using Equation 10, the adaptation step-size for subband k and frame-index n is obtained as:

$$\mu_p(k, n) = \xi(n)\left(\frac{N_{ZZ,p}(k, n)}{B_{YY}(k, n) + \delta}\right)\mu_o \quad \text{(Equation 12)}$$

where $\mu_o$ is a nominal step-size. $\mu_o$ may be used as an initial step size with scaling factors and the processes above used to modulate the step size during processing.

At a first time period, audio signals from the microphone array 102 may be processed as described above using a first set of weights for the filters 122. Then, the error E 136 associated with that first time period may be used to calculate a new set of weights for the filters 122, where the new set of weights is determined using the step size calculations described above. The new set of weights may then be used to process audio signals from a microphone array 102 associated with a second time period that occurs after the first time period. Thus, for example, a first filter weight may be applied to a noise reference signal associated with a first audio signal for a first microphone/first direction from the first time period. A new first filter weight may then be calculated using the method above and the new first filter weight may then be applied to a noise reference signal associated with the first audio signal for the first microphone/first direction from the second time period. The same process may be applied to other filter weights and other audio signals from other microphones/directions.

The above processes and calculations may be performed across sub-bands k, across channels p and for audio frames n, as illustrated in the particular calculations and equations.

The estimated non-noise (e.g., output) audio signal E 136 may be processed by a synthesis filterbank 128 which converts the signal 136 into time-domain audio output data 150 which may be sent to a downstream component (such as a speech processing system) for further operations.

In an alternate system configuration, the system may determine a coherence metric (which measures to what extent detected noise is diffuse versus coherent) to adjust the outputs of the FBF and/or the ABF or even to activate the ABF. For example, if the system determines a coherence metric that indicates that noise is primarily diffuse, the system may not turn on components in the ABF chain. Or the system may weight the output of the ABF 160 lower than the output of the FBF 140, to reflect that the diffuse noise cancelling output of the FBF should be weighted more than the coherent noise cancelling output of the ABF. If, however, the system determines a coherence metric that indicates that noise is primarily coherent (e.g., the coherence metric is above a certain threshold), the system may activate ABF components and/or weight the output of the ABF 160 higher than the output of the FBF 140, to reflect that the diffuse noise cancelling output of the FBF should be weighted less than the coherent noise cancelling output of the ABF.

To determine the coherence metric value (denoted by Γ) the system may perform a correlation of an audio signal received from a first microphone and an audio signal received from a second microphone. The coherence metric value may be calculated as:

$$\Gamma_{p,q}(k) = \frac{S_{p,q}(k)}{S_{p,p}(k) S_{q,q}(k)}$$

where, $S_{p,q}(k)$ denotes the cross-spectral density between the kth subband signal samples for pth and qth microphones of the array, $S_{p,p}(k)$ and $S_{q,q}(k)$ denotes the power spectral density for the pth and qth microphones, respectively.

The correlation may be a function of frequency. If the noise conditions are diffuse then the magnitude of the correlation function may form a certain pattern, for example a damping sinusoid. The system may then match the pattern of the correlation function to a stored pattern to determine if the correlation function matches a stored pattern corresponding to diffuse noise. If so, the system may determine a low value coherence metric and determine the noise is diffuse. If not, the system may determine a high value coherence metric and determine the noise is not diffuse.

Figure 7:
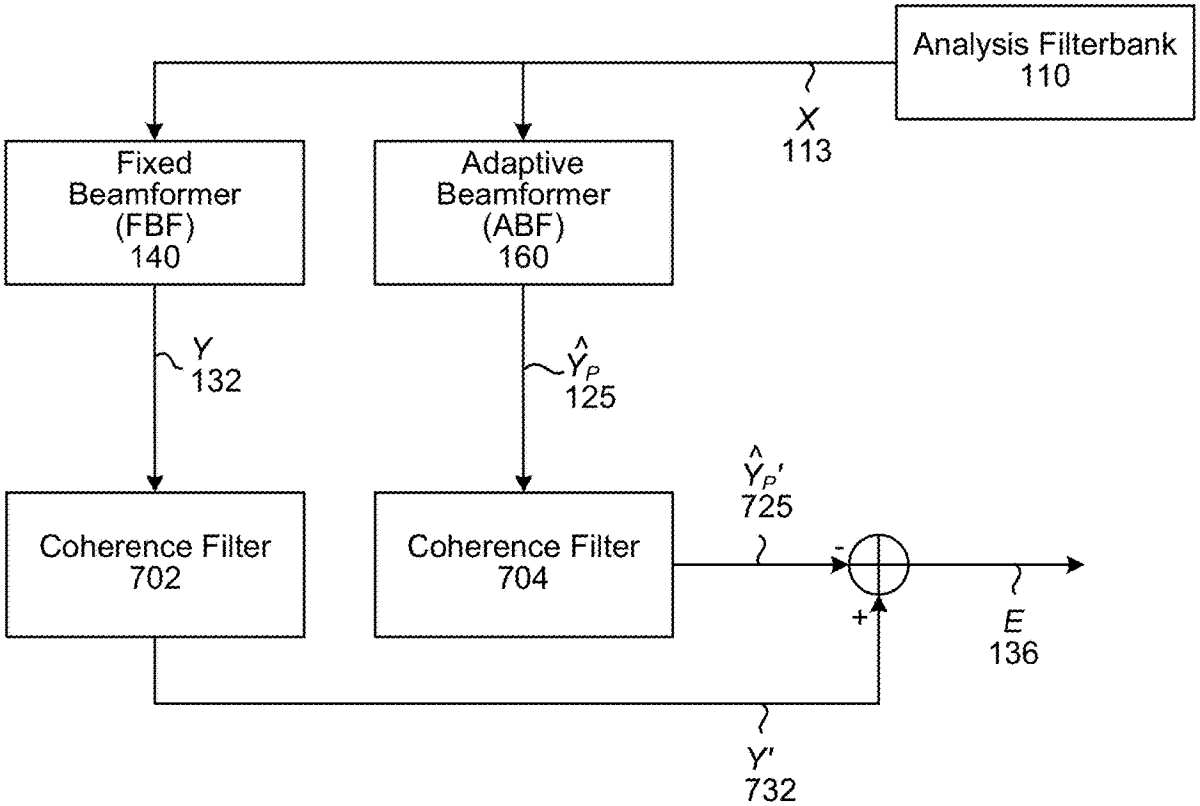
FIG. 7 illustrates determining an audio output based on coherence measurements according to embodiments of the present disclosure.

As shown in FIG. 7, the system may include a coherence filter 702 which may weight the FBF output 132 to form weighted FBF output Y' 732 (which is FBF output 132 weighted by a first coherence weight factor of coherence filter 702). The system may also include coherence filter 704 which may weight the ABF output 125 by a coherence weight factor to form weighted ABF output $\hat{Y}_P$' 725 (which is ABF output 125 weighted by a second coherence weight factor of coherence filter 704). For example, if the system detects primarily diffuse noise, the first coherence weight factor may be 0.8 while the second coherence weight factor may be 0.2. Other weights are also possible. The first coherence weight factor and second coherence weight factor may be related (for example, may add up to 1) depending on system configuration but need not necessarily be related. The weighted filter outputs may then be combined to form error E 136, for example using the equation $E = Y' - \hat{Y}_P'$. This error may be the weighted amplified audio signal.

Various machine learning techniques may be used to perform the training of the step-size controller 104 or other components. For example, the step-size controller may operate a trained model to determine the step-size (e.g., weighting factor adjustments). Models may be trained and operated according to various machine learning techniques. Such techniques may include, for example, inference engines, trained classifiers, etc. Examples of trained classifiers include conditional random fields (CRF) classifiers, Support Vector Machines (SVMs), neural networks (such as deep neural networks and/or recurrent neural networks), decision trees, AdaBoost (short for "Adaptive Boosting") combined with decision trees, and random forests. Focusing on CRF as an example, CRF is a class of statistical models used for structured predictions. In particular, CRFs are a type of discriminative undirected probabilistic graphical models. A CRF can predict a class label for a sample while taking into account contextual information for the sample. CRFs may be used to encode known relationships between observations and construct consistent interpretations. A CRF model may thus be used to label or parse certain sequential data, like query text as described above. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. For example, known types for previous queries may be used as ground truth data for the training set used to train the various components/models. Various techniques may be used to train the models including backpropagation, statistical learning, supervised learning, semi-supervised learning, stochastic learning, stochastic gradient descent, or other known techniques. Thus, many different training examples may be used to train the classifier(s)/model(s) discussed herein. Further, as training data is added to, or otherwise changed, new classifiers/models may be trained to update the classifiers/models as desired.

Figure 8:
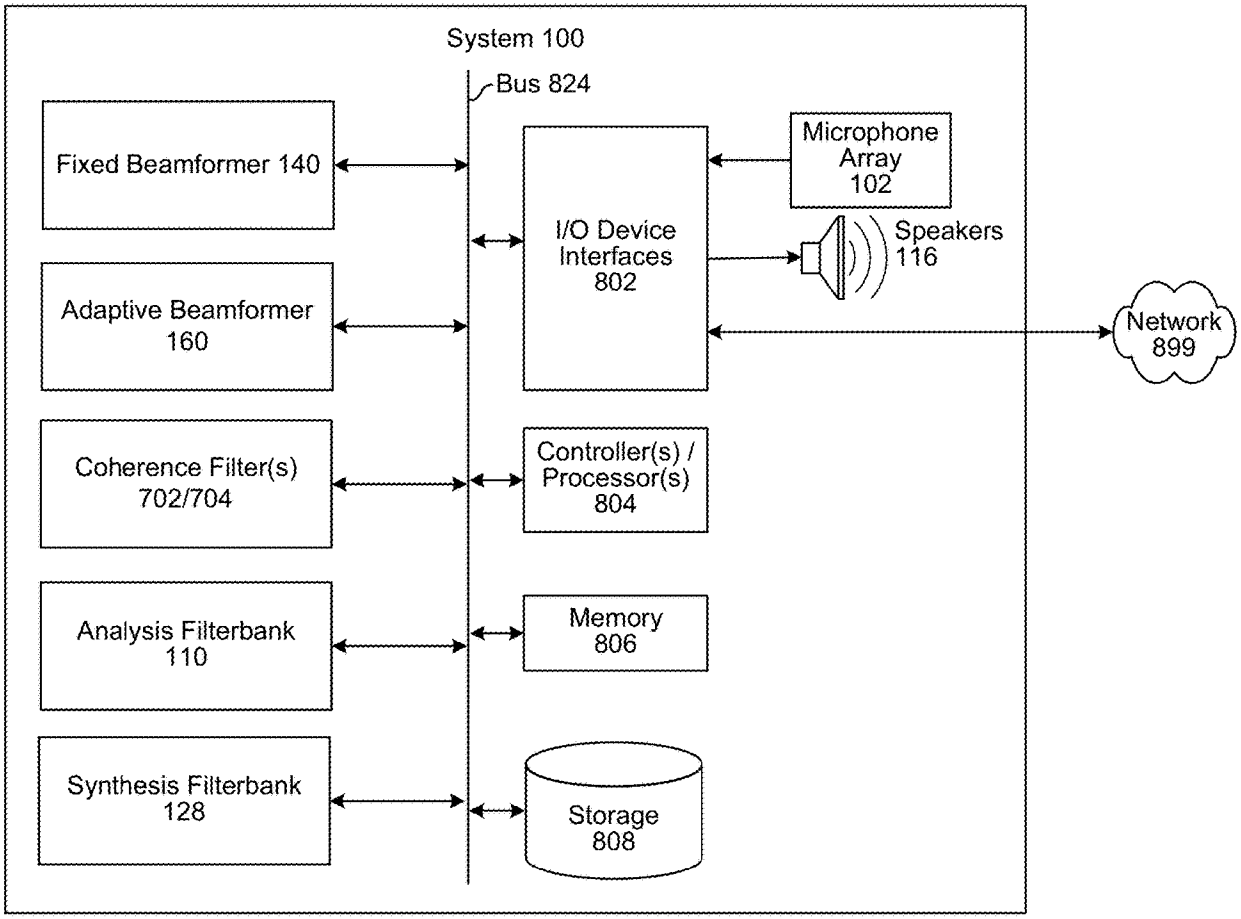
FIG. 8 is a block diagram conceptually illustrating example components of a system for echo cancellation according to embodiments of the present disclosure.

FIG. 8 is a block diagram conceptually illustrating example components of the system 100. In operation, the system 100 may include computer-readable and computer-executable instructions that reside on the system, as will be discussed further below.

The system 100 may include one or more audio capture device(s), such as a microphone array 102 which may include a plurality of microphones 202. The audio capture device(s) may be integrated into a single device or may be separate.

The system 100 may also include an audio output device for producing sound, such as speaker(s) 116. The audio output device may be integrated into a single device or may be separate.

The system 100 may include an address/data bus 824 for conveying data among components of the system 100. Each component within the system may also be directly connected to other components in addition to (or instead of) being connected to other components across the bus 824.

The system 100 may include one or more controllers/processors 804, that may each include a central processing unit (CPU) for processing data and computer-readable instructions, and a memory 806 for storing data and instructions. The memory 806 may include volatile random access memory (RAM), non-volatile read only memory (ROM), non-volatile magnetoresistive (MRAM) and/or other types of memory. The system 100 may also include a data storage component 808, for storing data and controller/processor-executable instructions (e.g., instructions to perform operations discussed herein). The data storage component 808 may include one or more non-volatile storage types such as magnetic storage, optical storage, solid-state storage, etc. The system 100 may also be connected to removable or external non-volatile memory and/or storage (such as a removable memory card, memory key drive, networked storage, etc.) through the input/output device interfaces 802.

Computer instructions for operating the system 100 and its various components may be executed by the controller(s)/processor(s) 804, using the memory 806 as temporary "working" storage at runtime. The computer instructions may be stored in a non-transitory manner in non-volatile memory 806, storage 808, or an external device. Alternatively, some or all of the executable instructions may be embedded in hardware or firmware in addition to or instead of software.

The system 100 may include input/output device interfaces 802. A variety of components may be connected through the input/output device interfaces 802, such as the speaker(s) 116, the microphone array 120, and a media source such as a digital media player (not illustrated). The input/output interfaces 802 may include A/D converters (not shown) and/or D/A converters (not shown).

The system may include a fixed beamformer 140, adaptive beamformer 160, coherence filter(s) 702/704, analysis filterbank 110, synthesis filterbank 128, and/or other components for performing the processes discussed above.

The input/output device interfaces 802 may also include an interface for an external peripheral device connection such as universal serial bus (USB), FireWire, Thunderbolt or other connection protocol. The input/output device interfaces 802 may also include a connection to one or more networks 899 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 899, the system 100 may be distributed across a networked environment.

Multiple devices may be employed in a single system 100. In such a multi-device system, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system. For example, certain components such as an FBF (including filter and sum component 130), adaptive beamformer (ABF) 160, may be arranged as illustrated or may be arranged in a different manner, or removed entirely and/or joined with other non-illustrated components.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the adaptive beamformer 160, beamformer 190, etc. may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A device comprising:

at least one processor;

a microphone array comprising at least:

a first microphone associated with a first direction relative to the device, a second microphone associated with a second direction relative to the device, and a third microphone associated with a third direction relative to the device;

a fixed beamformer configured to amplify audio data from a direction associated with an audio source;

an adaptive beamformer configured to amplify audio data from directions other than the direction associated with the audio source; and a memory device including instructions operable to be executed by the at least one processor to configure the device to:

receive a first plurality of audio signals corresponding to the microphone array and during a first time period, the first plurality of audio signals including at least:

a first audio signal corresponding to the first microphone, a second audio signal corresponding to the second microphone, and a third audio signal corresponding to the third microphone;

determine the audio source is located in the first direction relative to the device;

operate the fixed beamformer to amplify the first audio signal relative to other signals of the first plurality of audio signals to obtain a first amplified audio signal;

operate the adaptive beamformer to amplify the second audio signal relative to other signals of the first plurality of audio signals to determine a first noise reference signal;

multiply the first noise reference signal by a first weighting factor to obtain a first weighted noise reference signal, wherein the first weighting factor corresponds to a level of noise originating from the second direction;

operate the adaptive beamformer to amplify the third audio signal relative to other signals of the first plurality of audio signals to obtain a second noise reference signal;

multiply the second noise reference signal by a second weighting factor to obtain a second weighted noise reference signal, wherein the second weighting factor corresponds to a level of noise originating from the third direction;

combine at least the first weighted noise reference signal and the second weighted noise reference signal to obtain a combined weighted noise reference signal; and subtract the combined weighted noise reference signal from the first amplified audio signal to obtain an output audio signal.

2. The device of claim 1, wherein the instructions further configure the device to:

determine a third weighting factor by adding the first weighting factor and a first weighting factor adjustment;

determine a fourth weighting factor by combining the second weighting factor and a second weighting factor adjustment;

receive a second plurality of audio signals corresponding to the microphone array and during a second time period after the first time period, the second plurality of audio signals including at least:

a fourth audio signal corresponding to the first microphone, a fifth audio signal corresponding to the second microphone, and a sixth audio signal corresponding to the third microphone;

operate the adaptive beamformer to amplify the fifth audio signal relative to other signals of the second plurality of audio signals to obtain a third noise reference signal;

multiply the third noise reference signal by the third weighting factor;

operate the adaptive beamformer to amplify the sixth audio signal relative to other signals of the second plurality of audio signals to obtain fourth noise reference signal; and multiply the fourth noise reference signal by the fourth weighting factor.

3. The device of claim 2, wherein the instructions further configure the device to:

determine a first energy corresponding to the first amplified audio signal;

determine a second energy corresponding to the first noise reference signal;

determine a ratio of the first energy to the second energy; and determine the first weighting factor adjustment using the ratio.

4. The device of claim 1, wherein the instructions further configure the device to:

determine a correlation of the first audio signal and second audio signal as a function of frequency;

determine a coherence metric based at least in part on the correlation, the coherence metric representing a directionality of detected noise;

determine the coherence metric is above a directionality threshold; and activate the adaptive beamformer.

5. A device comprising:

at least one processor;

a microphone array comprising a plurality of microphones; and a memory device including instructions that, when executed by the at least one processor, cause the device to:

receive, during a first time period, a first plurality of audio signals from the microphone array;

determine, using the first plurality of audio signals, first audio data that corresponds to a direction of an audio source;

determine, using the first plurality of audio signals, second audio data that corresponds to a direction of a first noise source;

determine, based at least in part on the first audio data and the second audio data, a first weighting factor adjustment;

determine a first weighting factor based at least in part on a previously determined weighting factor and the first weighting factor adjustment;

determine first noise reference data by multiplying the second audio data by the first weighting factor;

determine, using the first plurality of audio signals, third audio data that corresponds to a direction of a second noise source;

determine, based at least in part on the third audio data, a second weighting factor adjustment;

determine a second weighting factor based at least in part on a second previously determined weighting factor and the second weighting factor adjustment;

determine second noise reference data by multiplying the third audio data by the second weighting factor;

determine combined noise reference data using the first noise reference data and the second noise reference data; and determine output audio data using the first audio data and the combined noise reference data.

6. The device of claim 5, wherein the instructions further cause the device to:

receive, during a second time period after the first time period, a second plurality of audio signals from the microphone array;

determine, using the second plurality of audio signals, fourth audio data that corresponds to the direction of the first noise source;

determine third weighted noise reference data by multiplying the fourth audio data by the first weighting factor;

determine, using the second plurality of audio signals, fifth audio data that corresponds to the direction of the second noise source;

determine fourth weighted noise reference data by multiplying the fifth audio data by the second weighting factor;

determine second combined noise reference data using the third weighted noise reference data and the fourth weighted noise reference data; and determine second output audio data using the second audio data and the second combined noise reference data.

7. The device of claim 5, wherein the instructions further cause the device to:

determine that at least a portion of the first audio data represents speech, wherein determining the first weighting factor adjustment is based at least in part on the at least the portion of the first audio data representing speech.

8. The device of claim 5, wherein the instructions further cause the device to:

determine a first energy corresponding to the first audio data;

determine a second energy corresponding to the first noise reference data;

determine a ratio of the first energy to the second energy; and determine the updated first weighting factor further using the ratio.

9. The device of claim 5, wherein the instructions further cause the device to:

determine a correlation of the first audio data and the second audio data as a function of frequency;

determine a coherence metric based at least in part on the correlation; and prior to determining the output audio data, determine that the coherence metric is above a threshold.

10. The device of claim 9, wherein the instructions further cause the device to:

determine a first coherence weight factor using the coherence metric;

multiply the first audio data by the first coherence weight factor to determine weighted audio data; and use the weighted audio data to obtain the output audio data.

11. A computer-implemented method comprising:

receiving, during a first time period, a first plurality of audio signals from a microphone array comprising a plurality of microphones;

determining, using the first plurality of audio signals, first audio data that corresponds to a direction of an audio source;

determining, using the first plurality of audio signals, second audio data that corresponds to a direction of a first noise source;

determining, based at least in part on the first audio data and the second audio data, a first weighting factor adjustment;

determining a first weighting factor based at least in part on a previously determined weighting factor and the first weighting factor adjustment;

determining first noise reference data by multiplying the second audio data by the first weighting factor;

determining, using the first plurality of audio signals, third audio data that corresponds to a direction of a second noise source;

determining, based at least in part on the third audio data, a second weighting factor adjustment;

determining a second weighting factor based at least in part on a second previously determined weighting factor and the second weighting factor adjustment;

determine second noise reference data by multiplying the third audio data by the second weighting factor;

determining combined noise reference data using the first noise reference data and the second noise reference data; and determine output audio data using the first audio data and the combined noise reference data.

12. The computer-implemented method of claim 11, further comprising:

receiving, during a second time period after the first time period, a second plurality of audio signals from the microphone array determining, using the second plurality of audio signals, fourth audio data that corresponds to the direction of the first noise source;

determining third weighted noise reference data by multiplying the fourth audio data by the first weighting factor;

determining, using the second plurality of audio signals, fifth audio data that corresponds to the direction of the second noise source;

determining fourth weighted noise reference data by multiplying the fifth audio data by the second weighting factor;

determining second combined noise reference data using the third weighted noise reference data and the fourth weighted noise reference data; and determining second output audio data using the second audio data and the second combined noise reference data.

13. The computer-implemented method of claim 11, further comprising:

determining that at least a portion of the first audio data represents speech, wherein determining the first weighting factor adjustment is based at least in part on the at least the portion of the first audio data representing speech.

14. The computer-implemented method of claim 11, further comprising:

determining a first energy corresponding to the first audio data;

determining a second energy corresponding to the first noise reference data;

determining a ratio of the first energy to the second energy; and determining the first weighting factor further using the ratio.

15. The computer-implemented method of claim 11, further comprising:

determining a correlation of the first audio data and the second audio data as a function of frequency;

determining a coherence metric based at least in part on the correlation; and prior to determining the output audio data, determining that the coherence metric is above a threshold.

16. The computer-implemented method of claim 15, further comprising:

determining a first coherence weight factor using the coherence metric;

multiplying the first audio data by the first coherence weight factor to determine weighted first audio data; and using the weighted first audio data to obtain the output audio data.

* * * * *